United States Patent [19]

Franz et al.

[11] 4,389,734

[45] Jun. 28, 1983

[54] IMPERVIOUS OVERSLEEVE WITH ANTIROLL-DOWN COLLAR FOR SURGICAL GOWN

[75] Inventors: Norman J. Franz, Germantown; Elizabeth B. Reynolds, Bartlett, both of Tenn.

[73] Assignee: The Buckeye Cellulose Corporation, Cincinnati, Ohio

[21] Appl. No.: 274,983

[22] Filed: Jun. 18, 1981

[51] Int. Cl.[3] ..... A41D 27/12; A41B 9/00

[52] U.S. Cl. ..... 2/59; 2/60; 2/114

[58] Field of Search ..... 2/59, 60, 269, 159, 2/162, 160, 114, 142, DIG. 7

[56] References Cited

U.S. PATENT DOCUMENTS

| | | | |
|---|---|---|---|
| 2,994,089 | 8/1961 | Ferguson et al. | 2/269 |
| 3,045,815 | 7/1962 | Abildgaard | 206/63.2 |
| 3,657,741 | 4/1972 | Blanco | 2/59 |
| 3,868,728 | 3/1975 | Krzewinski | 2/114 |
| 3,911,499 | 10/1975 | Benevento et al. | 2/114 |
| 4,133,624 | 1/1979 | Heavner et al. | 425/275 |

FOREIGN PATENT DOCUMENTS

| | | | |
|---|---|---|---|
| 60035 | 10/1938 | Norway | 2/269 |

*Primary Examiner*—Doris L. Troutman

*Attorney, Agent, or Firm*—Milton B. Graff, IV; John V. Gorman; Richard C. Witte

[57] ABSTRACT

A surgical gown sleeve has a polymeric material as an outer surface layer of at least a portion of the sleeve. A collar of material is attached to the lower forearm region of the sleeve and overlies a portion of the sleeve. The collar prevents roll-down of the cuff of a surgical glove which is pulled over it.

10 Claims, 2 Drawing Figures

IMPERVIOUS OVERSLEEVE WITH ANTIROLL-DOWN COLLAR FOR SURGICAL GOWN

TECHNICAL FIELD

This invention relates to a gown for use in surgical operations and, more specifically, to an impervious oversleeve material for such gown with a collar of material to help prevent roll-down of surgical glove cuffs.

BACKGROUND OF THE INVENTION

A gown is worn by a surgeon as a protective barrier between the surgeon and the patient. A gown helps to keep the surgeon any any clothing under the gown clean. The outer surface of the gown is clean and sterile to help prevent bacterial transmission to the patient during surgery.

The use of polymeric materials or coatings as a part of surgical gowns is becoming common due to their potential for reducing lint and for providing a liquid impervious barrier. The entire gown is generally not made of an impervious material because such a gown would cause thermal discomfort to the surgeon. However, in certain critical areas such as the forearm region, an impervious material is often employed to maintain a total barrier between the surgeon and the patient.

U.S. Pat. No. 3,657,741 issued Apr. 25, 1972, to Blanco discloses a surgical oversleeve made of fluid impervious material that is pulled on over a surgical gown to protect the forearm area. The oversleeve is held in position by elastic bands around the circumferences of its open ends which grip the wrist and upper arm of the wearer. U.S. Pat. No. 3,868,728 issued Mar. 4, 1975, to Krzewinski discloses a surgical gown with sleeves made of a liquid impervious polyethylene coated fabric. Impervious sleeves such as those disclosed in Blanco and Krzewinski protect the patient by preventing bacteria laden liquid, e.g. perspiration, from flowing through the gown from the surgeon to the outer surface of the gown where it may contact the patient. The smooth outer surface of the impervious materials used in these examples are nonlinting and thus also provide protection against contamination of the surgical opening from particulates sloughed from a gown sleeve.

A surgeon's glove has a cuff which extends a distance up the forearm covering the cuff of the sleeve of a surgical gown. The glove and the impervious portion of a sleeve as described above will combine to create an impervious barrier between the surgeon's hand and arm and the patient up to the top of the impervious portion of the sleeve, which is generally in the region of the surgeon's upper arm.

The cuff of a surgical glove which extends onto the forearm of a surgeon has some tendency to roll down as the surgeon's arm and hand move. When the portion of the forearm region of the sleeve of a surgeon's gown which the glove cuff covers has an outer surface layer of material having a low coefficient of friction, the occurrence of cuff roll-down of the surgeon's glove is substantially enhanced. U.S. Pat. No. 4,095,293 issued June 20, 1978, to Heavner et al. discloses one potential solution to the glove roll-down problem: a surgeon's glove having a textured cuff. However, such gloves would cost substantially more than the smooth-cuff surgeons gloves in general use. Also, the textured glove cuff would be expected to provide a less tight seal between the glove cuff and gown sleeve such that contaminants would be more likely to pass from the surgeon to the patient.

It is the object of the present invention to provide a surgeon's gown sleeve that helps prevent cuff roll-down of the surgeon's glove.

Another object of this invention is to provide a surgeon's gown sleeve that will provide, in conjunction with the surgeon's glove, a fluid impervious, non-linting covering for the surgeon's hand and lower arm.

Other objects and advantages of the invention will become apparent with reference to the following description and accompanying drawings.

DISCLOSURE OF THE INVENTION

The present invention concerns a surgical gown having a sleeve with a collar of fabric attached at some intermediate location of the lower forearm region of the sleeve. The collar overlies a portion of the sleeve.

DETAILED DESCRIPTION OF THE INVENTION

Figure 1:
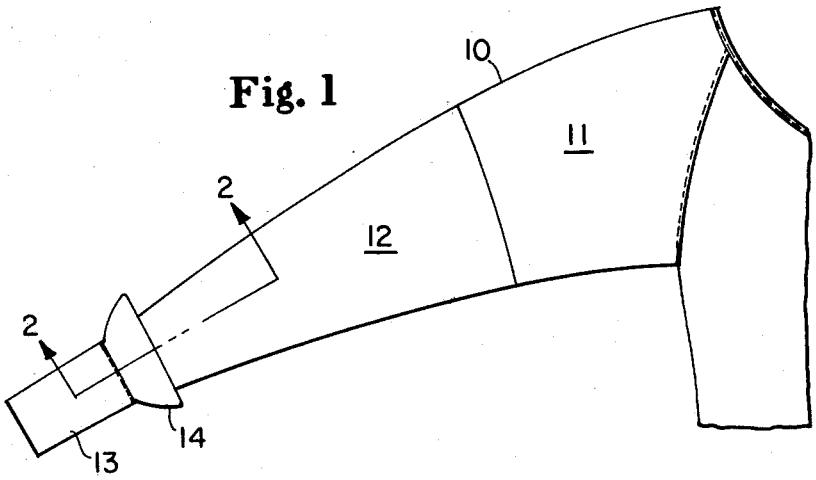
FIG. 1 is a fragmentary perspective view of a sleeve of a surgeon's gown employing an impervious oversleeve material and antiroll-down collar of the present invention.

Referring to the drawings wherein like reference characters are utilized to identify like parts through the several views, there is illustrated in FIG. 1 a surgical gown sleeve 10. The gown sleeve 10 is preferably constructed starting with a base material 11 which is preferably a nonwoven fabric such as that described in U.S. Pat. No. 4,113,911 issued on Sept. 12, 1978, to LaFitte et al., the disclosure of which is hereby incorporated by reference. A lower portion of the gown sleeve preferably has an outer surface layer or oversleeve material 12 made of a nonlinting material. A preferred material for the oversleeve material 12 is a polymeric material; such polymeric materials generally have a low coefficient of friction. A liquid impervious polymeric material is preferred for this oversleeve material 12.

The "outer surface layer" of the sleeve or "oversleeve material" 12 as used herein refers to this liquid impervious outer layer of the gown sleeve 10; it may be an integral layer of the gown sleeve material as disclosed in the '728 patent of Krzewinski, a layer of material adhered to the base sleeve material 11, or a separate oversleeve as disclosed in the '741 patent to Blanco. A preferred oversleeve material 12 is made of polymeric material with a preferred thickness of 0.5 to 6 mils (0.013 to 0.15 mm). Especially preferred is an oversleeve material 12 made of a proprietary polyethylene copolymer film, Elastoflex E, supplied by Clopay Corporation, Cincinnati, Ohio. This film is preferably 2 to 5 mil (0.051 to 0.13 mm) thick, most preferably 3.7 mil (0.094 mm) thick. The 3.7 mil (0.094 mm) thick Elastoflex E film has a basis weight of about 89 g/m$^2$. This film has a percent elongation of about 450% in both the machine and cross-machine directions and a minimum tensile strength of about 5 lb/in (900 g/cm) in the machine direction and about 4½ lb/in (800 g/cm) in the crossmachine direction. A proprietary antistat agent is preferably incorporated in resin for producing this film so that the film meets National Fire Protection Association (NFPA) Code 56A requirements. It is preferable that this film be adhered to the base sleeve material 11 and extend from above the elbow to the cuff 13 of the sleeve.

The sleeve 10 preferably has a standard cuff 13 made of material such as a double layer of 100% polyester knit. Attached at an intermediate location of the lower forearm region of the sleeve 10, preferably at the juncture of the cuff 13 and the base sleeve material 11, there is a collar 14 of material.

Figure 2:
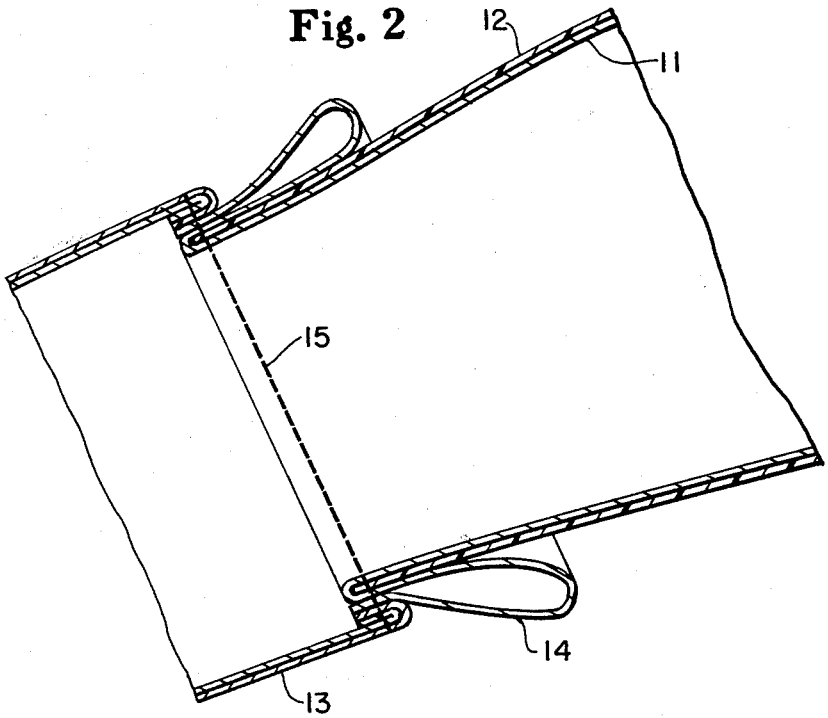
FIG. 2 is a fragmentary enlarged sectional view taken along line 2—2 of FIG. 1.

A preferred construction of the sleeve 10 is depicted in FIG. 2 wherein the thicknesses of the materials are exaggerated for clarity. A standard gown sleeve without cuff 13 is made from the base material 11 ahd has an extra allowance of base material about 10 centimeters in length at the lower end of the partial sleeve. A frustoconically shaped piece of liquid impervious oversleeve material 12 is placed over the base material 11 partial sleeve allowing the extra 10 centimeters of base material 11 to extend beyond the oversleeve material 12. The oversleeve material 12 can be attached to the base material 11 by any conventional means; adhesive attachment or heat sealing are preferred in order to ensure that no holes are introduced into the oversleeve material 12 which would allow the passage of fluid. The extra 10 centimeters of base sleeve material 11 is folded back over the lower end of the oversleeve material 12 and then folded again in the opposite direction to form a double thickness collar 14 of base material 11 at the end of the partially completed sleeve. The collar 14 can either be affixed in its position by any conventional means at this time or when the cuff 13 is affixed to form the end of the sleeve 10. The collar 14 and cuff 13 are preferably affixed in position as shown by dashed line 15 at the same time by a conventional means such as sewing or with adhesive. The collar 14 overlies a portion of the sleeve 10, preferably encircling it.

FIG. 2 shows the collar 14 to be an extension of the base sleeve material 11 as is preferred. Alternatively, the collar 14 could be made of any other type of fabric or material. It can be attached, as shown in FIG. 2, at the juncture between the cuff 13 and the base sleeve material 11, or affixed in any manner in a position overlying the sleeve 10 at any intermediate location along the forearm portion of the sleeve 10 such that it would be covered by the cuff of a surgical glove when the glove is pulled over the gown sleeve 10 and collar 14 by the wearer.

For the collar 14 to effectively prevent cuff roll-down of a surgical glove, the bulk of the collar 14 material must be such that it causes a local bulge in the glove cuff when the glove is donned and the glove cuff is extended over the gown sleeve 10 above the collar 14. With a surgeon's gown and gloves donned in this manner, measurements have been made of the diameter of the glove cuff at the bulge and about one-half inch (1.3 cm) toward the opening of the glove from the bulge. Such measurements have revealed that when the collar 14 causes the diameter of that portion of the glove cuff overlying it to be at least about 5% greater, preferably at least about 8% greater, than the adjacent diameter of the glove cuff toward the opening of the glove where it does not overlie the collar 14, the collar effectively prevents roll-down of the glove cuff.

The collar 14 could be formed from an extension of the oversleeve material 12 although this is not preferred since it is less effective as an antiroll-down collar due to its low coefficient of friction and lack of bulk. Also, the collar could be formed from an extension of the cuff 13 material, or be a separate piece of material.

While particular embodiments of the present invention have been illustrated and described, it would be obvious to those skilled in the art that various changes and modifications can be made without departing from the spirit and scope of the invention. It is intended to cover, in the appended claims, all such modifications that are within the scope of this invention.

What is claimed is:

1. A surgical gown sleeve the improvement of which comprises a collar attached at an intermediate location of the forearm region of said sleeve and overlying a portion of said sleeve, said collar having sufficient bulk such that it causes a local bulge in the cuff of a surgeon's glove donned over said collar, whereby the diameter of said glove cuff at said bulge is at least about 5% greater than the adjacent diameter of said glove cuff toward the opening of said glove where said glove cuff does not overlie said collar.

2. A surgical gown sleeve comprising an outer surface layer on at least a portion of the forearm region of said sleeve having a low coefficient of friction, and a collar attached at an intermediate location of the forearm region of said sleeve and overlying a portion of said sleeve, said collar having sufficient bulk such that it causes a local bulge in the cuff of a surgeon's glove donned over said collar, whereby the diameter of said glove cuff at said bulge is at least about 5% greater than the adjacent diameter of said glove cuff toward the opening of said glove where said glove cuff does not overlie said collar.

3. A surgical gown sleeve comprising a base material, a liquid impervious outer surface layer covering said base material on at least a portion of the forearm region of said sleeve, and a collar attached at an intermediate location of the forearm region of said sleeve and overlying a portion of said sleeve.

4. The sleeve of claim 3 wherein said liquid impervious outer surface layer is a polymeric material having a low coefficient of friction.

5. the sleeve of claim 4 wherein said sleeve comprises a cuff forming the lower end of said sleeve, said cuff being joined to said base material, said polymeric material extending from said cuff to above the elbow of said sleeve, and said collar is a portion of said base material extending from the juncture of said base material and said cuff and encircling said sleeve.

6. The sleeve of claim 5 wherein said base material is a nonwoven material.

7. The sleeve of claim 6 wherein said polymeric material is a 2–5 mil thick polyethylene copolymer film, said film being adhered to said base material.

8. The sleeve of claim 3 wherein said collar has sufficient bulk such that it causes a local bulge in the cuff of a surgeon's glove donned over said collar, whereby the diameter of said glove cuff at said bulge is at least about 5% greater than the adjacent diameter of said glove cuff toward the opening of said glove where said glove cuff does not overlie said collar.

9. The sleeve of claim 5 wherein said collar has sufficient bulk such that it causes a local bulge in the cuff of a surgeon's glove donned over said collar, whereby the diameter of said glove cuff at said bulge is at least about 5% greater than the adjacent diameter of said glove cuff toward the opening of said glove where said glove cuff does not overlie said collar.

10. The sleeve of claim 3 wherein said collar has sufficient bulk such that it causes a local bulge in the cuff of a surgeon's glove donned over said collar, whereby the diameter of said glove cuff at said bulge is at least about 8% greater than the adjacent diameter of said glove cuff toward the opening of said glove where said glove cuff does not overlie said collar.

* * * * *

UNITED STATES PATENT AND TRADEMARK OFFICE

CERTIFICATE OF CORRECTION

PATENT NO. : 4,389,734

DATED : June 28, 1983

INVENTOR(S) : Norman J. Franz and Elizabeth B. Reynolds

It is certified that error appears in the above-identified patent and that said Letters Patent is hereby corrected as shown below:

Column 1, line 16, "any", first occurrence, should read -- and --.

Column 3, line 16, "ahd" should read -- and --.

Signed and Sealed this

*Twenty-first* Day of *February 1984*

[SEAL]

*Attest:*

GERALD J. MOSSINGHOFF

*Attesting Officer*

*Commissioner of Patents and Trademarks*